US006132032A

United States Patent [19]

Bryant et al.

[11] Patent Number: 6,132,032

[45] Date of Patent: Oct. 17, 2000

[54] THIN-FILM PRINT HEAD FOR THERMAL INK-JET PRINTERS

[75] Inventors: Frank R. Bryant, Denton, Tex.; John E. Turner, Corvallis, Oreg.

[73] Assignee: Hewlett-Packard Company, Palo Alto, Calif.

[21] Appl. No.: 09/373,827

[22] Filed: Aug. 13, 1999

[51] Int. Cl.[7] ..... B41J 2/05

[52] U.S. Cl. ..... 347/59

[58] Field of Search ..... 347/54, 56, 57, 347/58, 59

[56] References Cited

U.S. PATENT DOCUMENTS

| | | | |
|---|---|---|---|
| 3,852,563 | 12/1974 | Bohorquez et al. | 347/58 |
| 3,973,106 | 8/1976 | Ura | 219/216 |
| 4,429,321 | 1/1984 | Matsumoto | 347/59 |
| 4,490,728 | 12/1984 | Vaught et al. | 347/63 |
| 4,513,298 | 4/1985 | Scheu . | |
| 4,514,741 | 4/1985 | Meyer . | |
| 4,528,574 | 7/1985 | Boyden . | |
| 4,535,343 | 8/1985 | Wright et al. . | |
| 4,616,408 | 10/1986 | Lloyd . | |
| 4,632,725 | 12/1986 | Hartmann et al. | 156/469 |
| 4,695,853 | 9/1987 | Hackleman et al. . | |
| 4,716,423 | 12/1987 | Chan et al. | 347/65 |
| 4,719,477 | 1/1988 | Hess | 347/59 |
| 4,725,859 | 2/1988 | Shibata et al. | 347/58 |
| 4,809,428 | 3/1989 | Aden et al. | 347/63 |
| 4,847,630 | 7/1989 | Bhaskar et al. | 347/63 |
| 4,862,197 | 8/1989 | Stoffel | 347/59 |
| 4,922,265 | 5/1990 | Pan | 347/65 |
| 4,927,505 | 5/1990 | Sharma et al. | 204/34.5 |
| 4,931,813 | 6/1990 | Pan et al. . | |
| 4,965,611 | 10/1990 | Pan et al. | 347/63 |
| 5,008,689 | 4/1991 | Pan et al. | 347/63 |
| 5,010,355 | 4/1991 | Hawkins et al. | 347/65 |
| 5,122,812 | 6/1992 | Hess et al. | 347/59 |
| 5,159,353 | 10/1992 | Fasen et al. | 347/59 |
| 5,229,785 | 7/1993 | Leban . | |
| 5,310,711 | 5/1994 | Drowley et al. | 437/141 |
| 5,318,924 | 6/1994 | Lin et al. | 437/195 |
| 5,420,627 | 5/1995 | Keefe et al. | 347/58 |
| 5,568,171 | 10/1996 | Keefe et al. | 347/58 |
| 5,681,764 | 10/1997 | Hess et al. | 347/59 |

FOREIGN PATENT DOCUMENTS

| | | |
|---|---|---|
| 0778139 A1 | 5/1996 | European Pat. Off. . |
| 62-204964 | 9/1987 | Japan . |
| 62-242552 | 10/1987 | Japan . |
| 4110161 | 4/1992 | Japan . |

*Primary Examiner*—John Barlow
*Assistant Examiner*—Juanita Stephens

[57] ABSTRACT

A thin-film print head is provided that includes at least one MOSTFT transistor, at least one resistor, a conductive line between the transistor and resistor. External interconnects between the internal circuitry of print head and external driver circuitry are provided. The thin-film print head device is adjacent to an ink barrier and an orifice plate that together define the firing chamber. Each firing chamber has associated with it a respective thin-film resistor of the print head that is selectively driven by a respective transistor. The transistor includes a source, a gate, a channel, and a drain, wherein the source, channel, and drain are formed by a first polysilicon layer. The MOSTFT transistor selectively drives the resistor with sufficient current to vaporize ink in the chamber and eject ink therefrom. The MOSTFT transistor allows the print head to be manufactured on a relatively inexpensive, non-silicon substrate or a less expensive silicon substrate, due to the less restrictive criteria for the substrate material required by MOSTFT transistors. The substrate may also comprise a material that provides enhanced thermal conductivity to act as a substantial heat sink for the print head.

17 Claims, 2 Drawing Sheets

THIN-FILM PRINT HEAD FOR THERMAL INK-JET PRINTERS

FIELD OF THE INVENTION

This invention relates to a thin-film print head for thermal ink-jet printing and methods for fabrication of the same.

BACKGROUND AND SUMMARY OF THE INVENTION

An ink-jet printer includes a pen in which small droplets of ink are formed and ejected toward a printing medium. Such pens include print heads with orifice plates having very small nozzles through which the ink droplets are ejected. Adjacent to the nozzles (inside the print head) are ink chambers, where ink is stored prior to ejection. Ink is delivered to the ink chambers through ink channels that are in fluid communication with an ink supply. The ink supply may be, for example, contained in a reservoir part of the pen.

Ejection of an ink droplet through a nozzle may be accomplished by quickly heating a volume of ink within the adjacent ink chamber. The rapid expansion of ink vapor forces a portion of the ink in the chamber through the nozzle in the form of a droplet. This process is called "firing." The ink in the chamber is heated with a heat transducer that is aligned adjacent to the nozzle. Typically, the heat transducer is a resistor, or piezoelectric transducer. Such printers are known as thermal ink-jet printers.

Thin-film resistors are typically used in print heads of thermal ink-jet printers. In such a device, a resistive heating material is typically disposed on a silicon substrate. Conventional fabrication techniques allow placement of a substantial number of resistors on a silicon wafer substrate.

In the past, the number of resistors applied to the silicon substrate was limited by the conductive components used to electrically connect the print head to external pulse driver circuitry for selectively heating the resistors. Thus, thermal inkjet print heads have been developed which incorporate pulse driver circuitry directly on the print head silicon substrate with the resistors. The incorporation of the pulse driver circuitry on the print head silicon substrate reduces the number of interconnect components needed to electrically connect the pen to the printer, thereby allowing fabrication of smaller ink-jet pens.

The pulse driver circuitry located on the silicon substrate typically comprises MOSFET drive transistors (i.e., metal oxide semiconductor field effect transistors). The integrated circuitry (i.e., resistors, transistors, and interconnects) is dimensionally defined on the substrate by conductive trace patterns, lithographically formed using conventional masking, ultraviolet exposure and etching techniques known in the art. Accordingly, in typical ink-jet print heads, the silicon substrate provides (1) mechanical support for the electronic components formed thereon, (2) acts as a thermal conductor, and (3) forms a part of the electronic device (i.e., a channel of the MOSFET transistor is formed in (or "by") the silicon substrate).

The pulse driver circuitry (hereafter referred to as a print head) is affixed adjacent to an ink barrier and an outer orifice plate. The internal geometry of the ink barrier defines the shape of the ink chamber. The ink chamber is situated above, and aligned with, a corresponding resistor which, when heated, ejects a droplet through the chamber nozzle. The integration of driver components and heater resistors on the same print head substrate requires multi-layer connective circuitry so that the driver transistors can communicate with the resistors and other portions of the printing system.

The amount of energy necessary for ejection of ink droplets from the chamber is known in the art as "turn on energy" or TOE. A higher TOE may result in excessive print head heating. Excessive print head heating generates bubbles from air dissolved in the ink and causes the ink vapor bubble to form prematurely. Air bubbles within the ink and premature formation of the vapor droplet result in poor ink droplet formation and, thus, poor print quality. Print speed must be slowed to a rate that prevents excessive print head heating. Accordingly, the thermal conductivity of the underlying substrate factors significantly in the control of ink droplet formation and firing characteristics of the print head.

The present invention provides an integrated, thin-film print head for a thermal ink-jet printer. The driver circuitry includes MOSTFT transistors (i.e., metal oxide semiconductor thin film transistors). Accordingly, the print head is manufactured on a relatively inexpensive, non-silicon substrate or a less expensive silicon substrate, due to the less restrictive criteria for the substrate material required by MOSTFT transistors. Further, the non-silicon substrate may comprise a material that provides enhanced thermal conductivity. A relatively thermally conductive substrate acts as a heat sink for the print head, thereby reducing print head heating. Reduction of print head heating allows the printer to operate at higher speeds without degradation of the print quality.

More specifically, the thin-film, ink-jet print head of the present invention includes at least one MOSTFT transistor, a corresponding resistor, and interconnections for electrical communication between the components. Because the print head comprises MOSTFT transistors, unlike conventional print heads having MOSFET transistors, channels are not formed in the substrate. As a result, the requirements of the substrate material are considerably reduced, allowing use of relatively inexpensive substrate material and simplifying the manufacturing process.

For example, because a MOSTFT transistor channel is not formed in the substrate, the manufacturing process of the present print head does not require controlled doping of the substrate or that the substrate have a specific oxygen content, as is required for the manufacture of conventional print head substrates. Further, in conventional MOSFET transistor print heads, the transistor channel was formed in the substrate and hence was "tied" to the body of the print head. As a result, each transistor channel was not necessarily electrically isolated from an adjacent transistor. Formation of the channel in the substrate thus frequently resulted in some leakage of current through the body, causing a change in the threshold voltage of neighboring transistors. This phenomena is known to those persons skilled in the art as "body effect."

Because the transistor channel of the present print head is not formed in the substrate, each transistor channel is effectively isolated from neighboring electronic components. Accordingly, the present print head avoids poor print head operation caused by body effects in conventional print heads.

FIGS. *2a–2f* are partial, cross-sectional diagrams depicting fabrication of an embodiment of the print head of the present invention.

DETAILED DESCRIPTION OF THE INVENTION

Figure 1:
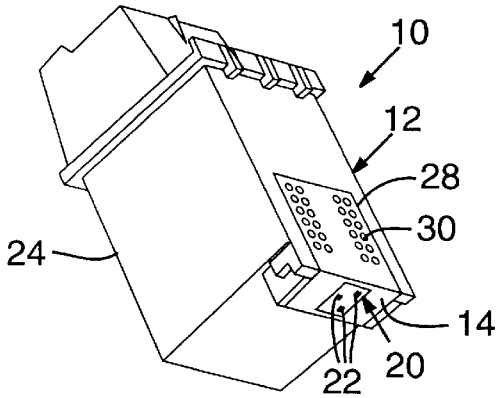
FIG. 1 is a perspective view of an ink-jet printer pen that includes a print head incorporating an embodiment of the thin-film print head of the present invention.

Referring to FIG. 1, the print head of the present invention is incorporated within an ink-jet pen 10. The preferred pen 10 includes a pen body 12 defining a reservoir 24. The reservoir 24 is configured to hold a quantity of ink. A print head 20 is fitted into the bottom 14 of the pen body 12 and is controlled for ejecting ink droplets. The print head 20 defines a set of nozzles 22 for expelling ink, in a controlled pattern, during printing. Each nozzle 22 is in fluid communication with a firing chamber 16 defined in the print head 20 (See FIG. 2*f*).

The pen includes an ink supply within the pen reservoir 24. A supply conduit (not shown) conducts ink from the reservoir 24 to ink channels (not shown) defined in the print head 20. The ink channels are configured so that ink moving therethrough is in fluid communication with each firing chamber 16 and hence each nozzle 22.

Conductive drivelines (discussed below) to the print head 20 are carried upon a circuit 28 mounted to the exterior of the pen body 12. Circuit contact pads 30 (shown enlarged for illustration in FIG. 1), at the ends of the drivelines engage similar pads carried on a matching circuit attached to the printer carriage (not shown).

Figure 2A:
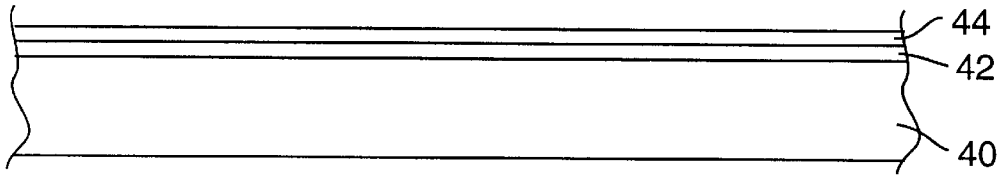
Figure 2B:
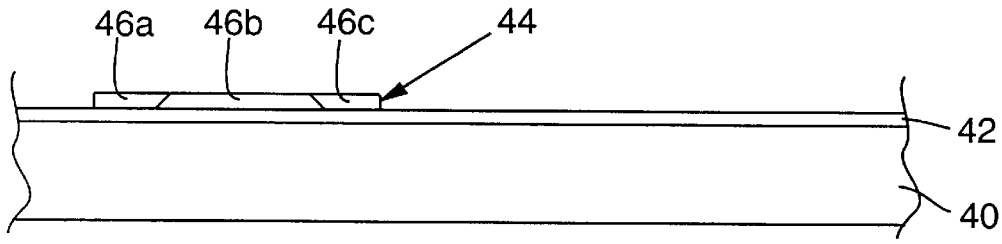
Figure 2C:
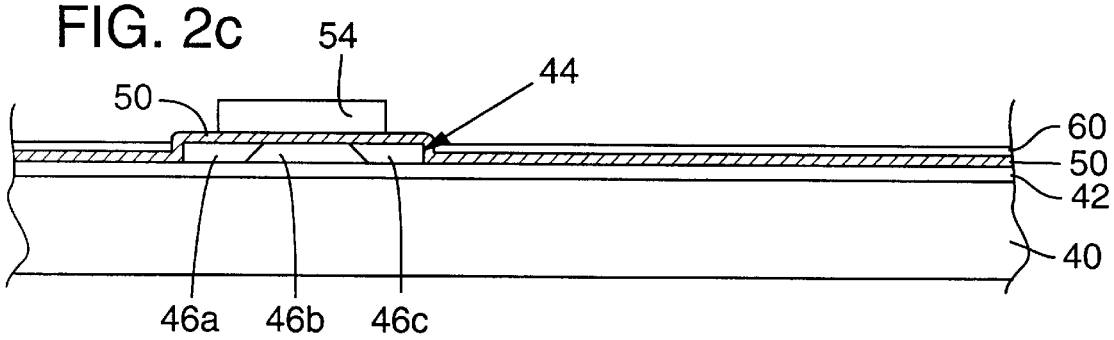
Figure 2D:
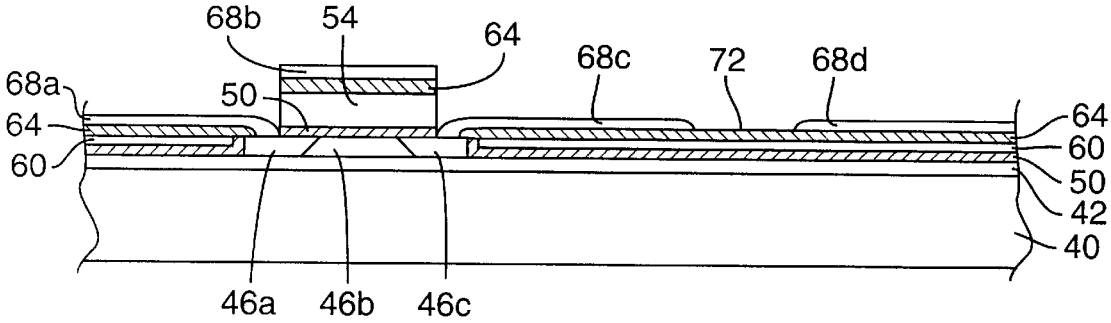
Figure 2E:
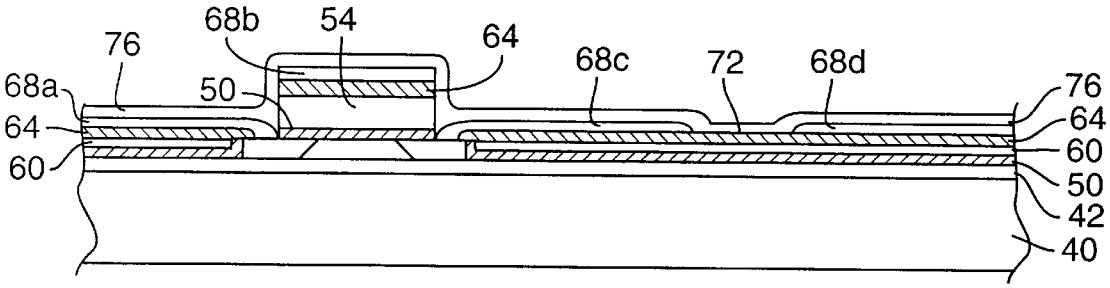
Figure 2F:
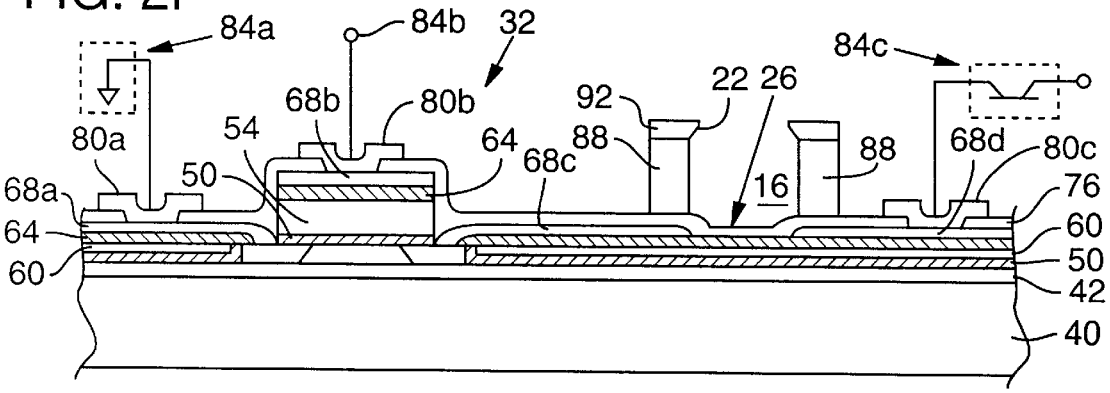

FIG. 2*f* depicts a partial, cross-sectional view of the print head 20. A thin-film print head of the present invention comprises at least one MOSTFT drive transistor 32, at least one resistor 26, a conductive line 68*c* between the transistor and resistor, and external interconnects 80*a*–80*c* between the internal circuitry (i.e., transistor 32, resistor 26) of print head 20 and external driver circuitry of the pen 10. The thin-film print head device is adjacent to an ink barrier 88 and an orifice plate 92, which together define the firing chamber 16.

More specifically, each firing chamber 16 has associated with it a respective thin-film resistor 26. Each resistor 26 is selectively driven (heated) by a respective drive transistor 32. The transistor 32 may be a MOSTFT transistor that includes a source 46*a*, a gate 54, a channel 46*b*, and a drain 46*c*. The source 46*a*, gate 54, channel 46*b*, and drain 46*c* define electrical contact regions to which various components (e.g., resistors) and electrical circuitry is connected. Each resistor 26 is in electrical communication with a respective drive transistor 32 through the conductive line 68*c*. The transistor 32 selectively drives the resistor 26 with sufficient current to instantly vaporize some of the ink in the chamber 16, thereby forcing a droplet through the nozzle 22.

The resistor 26 also electrically communicates, through a conductive driveline, with a conventional source of drain voltage that is located externally, in the printer unit (schematically illustrated at 84*c* in FIG. 2*f*). The transistor source 46*a* is connected through a conductive driveline to an external ground 84*a*. Additionally, an external lead 84*b* is connected to gate 54 through a conductive driveline.

Signals for firing the resistors 26 are generated by a microprocessor and associated drivers that apply the signals through the drivelines to the transistors. Each transistor 32 acts as electrical "switching" device, sending the firing signals through its respective conductive line 68*c* to the respective resistor 26.

The following discussion first concerns fabrication of an embodiment of the thin-film print head device, and then turns to its method of operation. FIGS. 2*a*–2*f* depict fabrication of the print head 20. It should of course be understood that FIGS. 2*a*–2*f* are not drawn to scale and that certain dimensions might be exaggerated or reduced in the interests of clarity. It should also be understood that FIGS. 2*a*–2*f* are merely diagrammatic and illustrate only schematically the contours of the various layers forming the print head.

Referring to FIG. 2*a*, fabrication of the presently disclosed print head begins with a substrate 40. The substrate 40 is preferably a sufficiently rigid, thermally conductive material that has a relatively planar surface. The substrate 40 may be more thermally conductive than conventional silicon substrates used to form prior art ink-jet printer print heads. A thermally conductive substrate acts as a heat sink for the print head device thereby reducing print head heating. Reduction of print head heating allows the printer to operate at higher speeds without degradation of the print quality. Substrate 40 is a heat resistant material capable of withstanding the temperatures necessary to fabricate the print head devices thereon. Additionally, the substrate 40 is capable of having a dielectric material adhere to its surface or of forming its own dielectric layer, as described below.

The substrate 40 may comprise, for example, glass, sapphire, relatively inexpensive silicon materials, or the like. To provide enhanced thermal conductivity, the substrate 40 may comprise, for example, a metal such as aluminum or aluminum oxide. One advantage of the presently disclosed print head and method of fabrication thereof, is that the substrate 40 may comprise a variety of materials that are significantly less expensive that the silicon substrates of conventional print heads. Because the substrate 40 is not a part of the electrical componentry (as is the case for conventional print head silicon substrates), the substrate may be a relatively inexpensive, non-silicon substrate or a less expensive silicon substrate. For example, any doping level and/or oxygen concentration is acceptable for the substrate 40 of the presently disclosed print head.

A dielectric layer 42 (also referred to as an electrical insulation layer) is formed on or is deposited on an upper surface of the substrate 40 (FIG. 2*a*). Dielectric layer 42 may, for example, comprise a chemical vapor deposited (CVD) silicon oxide layer, a refractory metal oxide, or any of a variety of dielectric organic materials. Alternatively, dielectric layer 42 may be formed by oxidizing an upper portion of the substrate 40. That is, the upper portion of the substrate forms the dielectric material that electrically insulates the substrate from the components formed thereon. Oxidation of the upper portion of the substrate 40 provides superior planarity for formation of the print head devices thereon.

The type of material used to form the substrate 40, in part, dictates the desirable thickness of dielectric layer 42. For example, if substrate 40 comprises glass or aluminum oxide, no dielectric layer 42 is necessary because glass and aluminum oxide are dielectrics themselves. If, however, substrate 40 comprises some type of silicon material, the dielectric layer 42 is preferably from about 3000 Å to about 1.5 $\mu$m in thickness (with a thickness of 0.9 $\mu$m being preferable). The important factor is that dielectric layer 42 serve as an electrical insulator to the circuit that will be built on its surface (if the substrate material is not a dielectric itself). The dielectric layer 42 is relatively thermally conductive so that substrate 40 may act as a heat sink for the print head.

A first polysilicon layer 44 is uniformally deposited preferably by low-pressure chemical vapor deposition (LPCVD) over dielectric layer 42. The first polysilicon layer 44 is, preferably, from about 0.1 $\mu$m to about 10 $\mu$m in thickness. A first polysilicon layer 44 thickness of from about 0.1 $\mu$m to about 1 $\mu$m has been found to work well. A first polysilicon layer 44 having a thickness of about 0.1 $\mu$m reduces the time required to form the layer, and hence reduces the overall fabrication process time. The first polysilicon layer 44 eventually forms the source, channel, and drain of the transistor 32 (see FIG. 2*f*). Because the transistor channel of the present print head is not formed in the substrate, each transistor channel is effectively isolated from neighboring electronic components. Accordingly, the present print head avoids the typical poor print head operation caused by body effects in conventional print heads.

Following deposition of the first polysilicon layer 44, the first polysilicon layer may be implanted along its entire depth to increase its conductivity (i.e., reduce the layer's resistivity). The first polysilicon layer 44 is preferably lightly doped to make it P-type, but may be doped to be N-type. Regions (also referred to as portions) of the implanted first polysilicon layer 44 eventually serve as the source 46*a*, the channel 46*b*, and the drain 46*c*. The source 46*b* and drain 46*c* are formed later, as discussed below. Polysilicon layer 44 is preferably doped with a p-type dopant, such as boron difluoride by ion implantation techniques well known in the art. Layer 44 may also be doped using thermal diffusion techniques with classical chemical dopants such as, for example, phosphorous oxychloride, boron trichloride or boron tribromide. First polysilicon layer 44 may be doped by ion implantation at levels of from about 0 to about $5\times10^{16}$ atoms/cm$^3$, and, preferably at a level of about $0.05\times10^{16}$ atoms/cm$^3$.

Referring to FIG. 2*b*, the first polysilicon layer 44 is then patterned for formation of the source 46*a*, channel 46*b*, and drain 46*d* of the transistor 32 (shown in FIG. 2*f*). The first polysilicon layer 44 is patterned using conventional masking and etching processes, such as by reactive ion etching, plasma etching, or ion milling, using etchants such as chlorine or carbon tetrachloride. For example, the first polysilicon layer 44 may be patterned by application of photoresist and may then be etched using sulfur hexafluoride ($SF_6$). The first polysilicon layer 44 may be removed from the portion underlying the to be formed resistor, but does not need to be removed.

Referring to FIG. 2*c*, a gate oxide layer 50 is then deposited or grown substantially uniformly over the remaining portion of first polysilicon layer 44 and the exposed portion of dielectric layer 42. The gate oxide layer 50 preferably has a thickness of from about 100 to about 1500 Å, with a thickness of about 1000 Å working well. Gate oxide layer 50 may comprise thermally grown silicon dioxide.

A second polysilicon layer is then deposited on the gate oxide layer 50 to form a gate 54. Specifically, the second polysilicon layer is patterned and etched to define the transistor gate 54 (FIG. 2*c*). Preferably, the gate 54 comprises polysilicon deposited by low-pressure chemical vapor deposition (LPCVD) at a thickness of from about 1000 to about 8000 Å, and with a thickness of from about 3300 to about 3900 Å has been found to work well (about 3600 Å being typical).

The second polysilicon layer is etched to form gate 54, using conventional etching techniques, such as plasma etching, reactive ion etching, or ion milling, using etchants, such as chlorine or carbon tetrachloride. However, any suitable etchant that selectively removes the undesired portions of the second polysilicon layer to form the gate 54 may be used. The portions of gate oxide layer 50 covering the source 46*a* and drain 46*c* may also be removed at this point. The gate 54 covers the channel 46*b* and leaves the source 46*a* and the drain 46*c* exposed (although gate oxide layer 50 may still cover such portions and be removed later in the process, as discussed below).

Another doping step dopes the source 46*a* and drain 46*c* of the transistor 32. The source 46*a* and drain 46*c* are preferably doped using, for example, $POCl_3$, or implanted with $PH_3$, arsene, or the like so that the source and drain are N-type (if the channel is P-type). The source 46*a* and drain 46*c* are preferably doped at a level of from about $5\times10^{19}$ atoms/cm$^3$ to about $2\times10^{20}$ atoms/cm$^3$ with a dopant level of about $1\times10^{20}$ atoms/cm$^3$ being preferable.

A protective, second dielectric layer 60 may then be applied to cover the gate 54, source 46*a*, drain 46*c*, and the other exposed portions of the gate oxide layer 50. The second dielectric layer may comprise any suitable dielectric, such as silicon dioxide applied by conventional CVD processes. The second dielectric layer 60 is preferably from about 3000 to about 10,000 Å in thickness (typically about 7500 Å). Silicon nitride also forms an excellent protective, dielectric layer.

If a second dielectric layer 60 has been applied, portions of the second dielectric layer 60 are then removed using conventional etch processes, to expose the source 46*a*, drain 46*c*, and gate 54 of the transistor. This etching process allows access to the source 46*a*, gate 54, and drain 46*c* (see FIG. 2*d*). If the portions of gate oxide layer 50 covering the source 46*a* and drain 46*c* were not removed previously, such portions of gate oxide layer 50 are now removed.

Referring to FIG. 2*d*, an electrically resistive layer 64 is then applied atop the second dielectric layer 60 (if applied), the source 46*a*, gate 54, and drain 46*c*. The resistive layer 64 may comprise a mixture of aluminum and tantalum. This composition is known in the art as an excellent resistive material, typically formed by sputtering from a mixed target of both materials (as opposed to alloying of the metals). The final mixture preferably comprises from about 40 to about 60 atomic percent aluminum. The resistive layer 64, alternatively, comprises phosphorous-doped polycrystalline silicon. This material is described in U.S. Pat. No. 4,513,298 to Scheu, incorporated herein by reference. The polycrystalline silicon is applied by LPCVD of silicon resulting from the decomposition of a selected silicon composition (e.g., silane) diluted by argon gas, also as discussed in U.S. Pat. No. 4,513,298.

The resistive layer 64 is applied having a substantially uniform thickness of from about 300 to about 1200 Å (typically about 900 Å). If the resistive layer 64 comprises polycrystalline silicon, the thickness is preferably from about 1000 to about 5000 Å. The resistive layer 64 is then patterned to remove portions of the resistive layer 64 that cover the source 46*a* and the drain 46*c*, such that the source 46*a* and drain 46*c* are exposed for interconnection to the corresponding resistor or other corresponding electronic component.

Continuing to refer to FIG. 2*d*, a conductive layer is then applied atop of the resistive layer 64 and the exposed source 46*a* and drain 46*c*. The conductive layer may comprise any suitable conductive material, such as the metals copper, aluminum, or gold. Alternatively, the conductive material may comprise a refractory metal. The material used to form the conductive layer may also be doped or may be combined with other materials. For example, if aluminum is used to form the conductive layer, the aluminum may be mixed with copper. Copper is used to help control electromigration problems typically associated with aluminum. For example, conductive layer may comprise about 97% by weight aluminum and about 3% by weight copper. Silicon could be mixed into the aluminum/copper material to prevent side reactions between the aluminum and other silicon-containing layers. In general, the conductive layer has a substantially uniform thickness of from about 2000 to about 10,000 Å (about 6000 Å has been found to work well) and is applied using conventional sputtering or vapor deposition techniques.

As shown in FIG. 2*d*, the conductive layer is then patterned and etched such that conductive portions 68*a*–68*d* remain. Specifically, conductive portions 68*a*–68*d* do not cover portion 72, which is part of resistive layer 64. The uncovered portion 72 functions as the resistor 26 that ultimately causes ink bubble nucleation during operation of the print head. The covered portion 68*c* (also referred to as "conductive line 68*c*") functions as a direct conductive bridge between the resistor 26 and the transistor drain 46*c*. The covered portion or conductive line 68*c* allows the transistor and resistor components of the print head to electrically communicate with each other.

Referring to FIG. 2*e*, a passivation layer 76 is then deposited to cover the print head device. Passivation layer 76 preferably comprises LPCVD silicon nitride, silicon carbide or silicon oxynitride. The passivation layer 76 protects the resistor 26 and other components from the corrosive action of the ink used within ink-jet pens. This protection is especially important with respect to the resistors since any physical damage thereto can impair operational capabilities of the print head.

A cavitation barrier (not shown) may be deposited over the passivation layer. A cavitation barrier, which covers the passivation layer 76 and resistor, eliminates or minimizes mechanical damage to the second dielectric layer 60, the portion of resistive layer 64 that forms the resistor 26, and the passivation layer 76 due to exposure to the momentum of unexpelled ink collapsing back into the ink chamber 16. The cavitation barrier may comprise tantalum, although other materials, such as, tungsten or molybdenum may be used. Passivation layer 76 may be sufficient to serve as both a protective layer from the corrosive ink and as a cavitation barrier.

Passivation layer 76 (and the cavitation barrier if present) is patterned and etched to define vias for the external electrical interconnects 80*a*–80*c* (FIG. 2*f*). Passivation layer 76 is patterned and etched using conventional deposition and etch processes, as discussed above. In a preferred embodiment of the present invention, external interconnects 80*a*–80*c* are formed of metals, such as titanium nitride, aluminum, titanium tungsten, or gold. External electrical interconnects 80*a*–80*c* are preferably deposited using conventional sputtering techniques. External interconnects 80*a*–80*c* are then patterned and etched. External interconnects 80*a*–80*c* connect the internal print head circuitry (i.e., transistor 32 and resistor 26) to the external driver circuitry.

More specifically, resistor 26, in addition to electrically communicating with transistor 32, electrically communicates through interconnect 80*c* with a conventional source 84*c* of drain voltage located externally in the printer unit (schematically illustrated in FIG. 2*f*). The source 46*a* of transistor 32 is connected to an external ground 84*a* through interconnect 80*a*. An external lead 84*b* is connected to gate 54 of transistor 32 through the interconnect 80*b*. At this point the transistor 32, resistor 26, and the interconnect circuitry are complete and the subsequent process steps concern completion of the firing chamber 16.

An ink barrier 88, forming part of the firing chamber 16, is applied (FIG. 2*f*). The ink barrier 88 may comprise a photosensitive polymer and defines the walls of the firing chamber 16. The ink barrier 88 also determines the spacing between the resistor 26 and the nozzle 22. A section of ink barrier 88 directly above the resistor 26 is removed (or the ink-jet barrier is selectively applied) in a conventional manner during the manufacturing process, in order to form the walls of the firing chamber 16.

An orifice plate 92 is bonded to the top of the ink barrier 88 (FIG. 2*f*). Orifice plate 92 controls the droplet shape and direction and preferably comprises nickel. The orifice plate 92 includes a plurality of nozzles 22, each nozzle corresponding to at least one of the resistors in the system. More specifically, orifice plate 92 includes openings that are directly above and aligned with respective resistors 26 of the print head device.

Operation of a preferred embodiment of the present invention is as follows. The transistor 32 receives electrical voltage through lead 84*b* from a source located external to the print head 20. The transistor 32 acts as a current switch, selectively allowing current to flow through conductive layer portion 68*c* to resistor 26, in order to fire a droplet from the chamber 16. When the transistor 32 is conductive, current travels from the source 46*a*, through the gate 54, into the drain 46*c* and to the resistor 26.

Specifically, a constant voltage is applied to the gate 54 through external lead 84*b*. When a voltage is applied to the gate 54, a field effect takes place in the surface of the channel 46*b* underlying the gate 54, making the channel conductive. No current can flow between the source 46*a* and drain 46*c* unless voltage is applied to the gate 54. Thus, the transistor 32 acts as a switch, as current only flows from the transistor 32 to the resistor 26 when voltage is applied to the gate 54 and channel 46*b* is formed.

Although the operation of the transistor 32 of the above-described embodiment is discussed in terms of a "normally-off" or enhancement MOSTFT, it is understood that the transistor component may also operate as a "normally-on" or depletion MOSTFT. That is, if conducting channel 46*b* exists at a zero bias (i.e., when no voltage is being applied to the gate) then the transistor component 32 is normally on. Thus, a constant bias or voltage is applied to the gate of a depletion MOSTFT, except when the resistor is to be fired. When the voltage to the gate is turned off, the transistor component is "on," and current is conducted to the resistor, thereby firing an ink droplet.

Resistor 26 acts as a heat transducer, converting the electrical signal selectively sent by the transistor 32 via the drain 46*c* and conductive line 68*c* to heat energy which heats the ink in the firing chamber 16. Thus forming ink droplets that are ejected from the pen 10.

Having described and illustrated the principles of the invention with reference to particular embodiments, it should be apparent that the invention can be further modified in arrangement and detail without departing from such principles.

What is claimed is:

1. A thermal ink-jet print head structure comprising:

a substrate;

at least one MOSTFT transistor formed on the substrate, the at least one MOSTFT transistor having a source, a channel, a drain, and a gate, the source, channel, and drain forming a first layer;

at least one resistor formed above the substrate; and a second layer separate from the first layer, the second layer forming a conductive layer electrically connecting the at least one MOSTFT transistor to the at least one resistor, the conductive layer functioning as an electrically conductive pathway between the at least one MOSTFT transistor and the at least one resistor.

2. The print head structure of claim 1, wherein the substrate comprises a dielectric material.

3. The print head structure of claim 1, wherein the substrate comprises a non-silicon material.

4. The print head structure of claim 1, wherein the substrate comprises undoped silicon material.

5. The print head structure of claim 1, wherein the source, the channel, and the drain comprise a first layer of polysilicon formed on the substrate.

6. The print head structure of claim 1, wherein a portion of the substrate forms a dielectric layer, above which at least one MOSTFT transistor is formed.

7. A thermal ink-jet print head structure comprising:

a substrate that provides support for electrical components formed thereon, wherein the substrate does not constitute any portion of the electrical components formed thereon;

a first layer forming a dielectric layer covering the substrate;

a second layer forming a source, channel, and drain of at least one transistor formed directly on the first layer;

at least one resistor formed above the substrate; and a third layer forming a conductive layer on top of the source and drain, the conductive layer electrically connecting the at least one transistor to the at least one resistor, the conductive layer functioning as an electrically conductive pathway between the at least one transistor and the at least one resistor.

8. The print head structure of claim 7, wherein the substrate comprises a non-silicon material.

9. The print head structure of claim 7, wherein the substrate comprises undoped silicon material.

10. The print head of claim 7, wherein the resistor is formed on a dielectric layer.

11. A thermal ink-jet print head structure comprising:

a substrate formed of an electrically insulating material, the substrate providing support for electrical components formed thereon;

at least one transistor formed above the substrate;

at least one resistor formed above the substrate; and a conductive layer formed on top of at least a portion of the transistor and electrically connecting the at least one transistor to the at least one resistor, the conductive layer functioning as an electrically conductive pathway between the at least one transistor and the at least one resistor.

12. The print head of claim 11, wherein the at least one transistor formed on the substrate includes a source, a channel, a drain, and a gate, and wherein the conductive layer covers the source and the drain.

13. The print head of claim 11, wherein the at least one transistor formed on the substrate includes a source, a channel, a drain, and a gate, wherein the source, the channel, and the drain comprise a first layer of polysilicon formed directly on a layer of dielectric material.

14. A thermal ink-jet print head structure comprising:

a substrate;

a first layer comprising polysilicon forming a source, channel, and drain of at least one transistor on the substrate;

a second layer comprising resistive material positioned above the substrate; and a third layer forming a conductive layer above the first layer of polysilicon and the second layer of resistive material, the conductive layer electrically connecting the at least one transistor to the resistive material and functioning as an electrically conductive pathway between the at least one transistor and the resistive material.

15. The print head structure of claim 14, wherein the transistor includes a gate and the gate comprises a second layer of polysilicon.

16. The print head structure of claim 14, wherein the substrate comprises a dielectric material.

17. The print head structure of claim 14, wherein the first layer of polysilicon is undoped polysilicon.

* * * * *